US012543777B2

(12) United States Patent
Lee

(10) Patent No.: US 12,543,777 B2
(45) Date of Patent: Feb. 10, 2026

(54) AEROSOL-GENERATING ARTICLE

(71) Applicant: KT&G CORPORATION, Daejeon (KR)

(72) Inventor: Moon Bong Lee, Seoul (KR)

(73) Assignee: KT&G CORPORATION, Daejeon (KR)

( * ) Notice: Subject to any disclaimer, the term of this patent is extended or adjusted under 35 U.S.C. 154(b) by 319 days.

(21) Appl. No.: 17/767,573

(22) PCT Filed: Nov. 2, 2021

(86) PCT No.: PCT/KR2021/015674
§ 371 (c)(1),
(2) Date: Apr. 8, 2022

(87) PCT Pub. No.: WO2022/103051
PCT Pub. Date: May 19, 2022

(65) Prior Publication Data

US 2024/0099358 A1 Mar. 28, 2024

(30) Foreign Application Priority Data

Nov. 10, 2020 (KR) ..... 10-2020-0149289

(51) Int. Cl.
*A24D 1/04* (2006.01)
*A24D 1/02* (2006.01)
*A24D 3/04* (2006.01)

(52) U.S. Cl.
CPC ..... *A24D 1/04* (2013.01); *A24D 1/027* (2013.01); *A24D 3/043* (2013.01)

(58) Field of Classification Search
None
See application file for complete search history.

(56) References Cited

U.S. PATENT DOCUMENTS 3,045,680 A * 7/1962 Smith ..... A24D 3/04 131/339
3,395,713 A * 8/1968 Ent-Keller ..... A24D 3/045 131/331

(Continued)

FOREIGN PATENT DOCUMENTS

CN 200953831 Y 10/2007
CN 101926513 A 12/2010

(Continued)

OTHER PUBLICATIONS

CN210520100U Translation (Year: 2020).*

(Continued)

*Primary Examiner* — Philip Y Louie
*Assistant Examiner* — Nicole A Szumigalski
(74) *Attorney, Agent, or Firm* — Sughrue Mion, PLLC

(57) ABSTRACT

An aerosol-generating article according to an embodiment of the disclosure includes: a tobacco rod having an outer circumferential surface surrounded by a wrapper; a filter rod having an outer circumferential surface surrounded by the wrapper, and including a segment including a structure supporting the wrapper in a transverse direction and at least one channel formed between the wrapper and the structure: and an airflow obstruction configured to obstruct an airflow of aerosol passing through the at least one channel.

6 Claims, 6 Drawing Sheets

230: 232, 234, 236, 238
232: 232-1, 232-2, 232-3, 232-4
234: 234-1, 234-2, 234-3, 234-4
236: 236-1, 236-2, 236-3, 236-4
238: 238-1, 238-2, 238-3

(56) References Cited

U.S. PATENT DOCUMENTS

| | | | | |
|---|---|---|---|---|
| 4,550,740 | A | 11/1985 | Riehl, Jr. | |
| 4,791,943 | A * | 12/1988 | Kupper | A24D 3/0283 493/42 |
| 2006/0130862 | A1 | 6/2006 | Dittrich et al. | |
| 2011/0297169 | A1 | 12/2011 | Li et al. | |
| 2013/0180535 | A1 | 7/2013 | Rooijakkers et al. | |
| 2018/0000152 | A1* | 1/2018 | Ito | A24D 3/041 |
| 2019/0021399 | A1 | 1/2019 | Silvestrini | |
| 2019/0083720 | A1* | 3/2019 | Leadley | A61M 15/06 |
| 2019/0116874 | A1* | 4/2019 | England | A24F 1/12 |
| 2019/0364969 | A1 | 12/2019 | Fu et al. | |
| 2020/0029616 | A1 | 1/2020 | Uthurry | |
| 2020/0359677 | A1 | 11/2020 | Cheong et al. | |
| 2021/0267269 | A1* | 9/2021 | Tan | A24D 3/04 |

FOREIGN PATENT DOCUMENTS

| | | | | |
|---|---|---|---|---|
| CN | 107568789 | A | | 1/2018 |
| CN | 110693083 | A | | 1/2020 |
| CN | 210520100 | U | * | 5/2020 |
| CN | 210580975 | U | | 5/2020 |
| CN | 210747217 | U | | 6/2020 |
| CN | 211353902 | U | | 8/2020 |
| CN | 111669981 | A | | 9/2020 |
| EP | 0 109 608 | A1 | | 5/1984 |
| EP | 0 482 634 | A1 | | 4/1991 |
| EP | 3 711 802 | A1 | | 9/2020 |
| JP | 50-135799 | U | | 11/1975 |
| JP | 60-141277 | A | | 7/1985 |
| WO | 2007/110650 | A1 | | 10/2007 |
| WO | 2014/049494 | A1 | | 4/2014 |
| WO | 2017/148773 | A1 | | 9/2017 |
| WO | 2019/073434 | A1 | | 4/2019 |
| WO | 2019/197316 | A1 | | 10/2019 |
| WO | 2020/001383 | A1 | | 1/2020 |
| WO | 2020/200693 | A1 | | 10/2020 |
| WO | 2020/201566 | A1 | | 10/2020 |
| WO | 2020/211753 | A1 | | 10/2020 |

OTHER PUBLICATIONS

CN200953831 Translation (Year: 2007).*

International Search Report for PCT/KR2021/015674 dated Feb. 8, 2022.

Written Opinion for PCT/KR2021/015674 dated Feb. 8, 2022.

Supplementary European Search Report issued Nov. 22, 2022 in European Application No. 21876745.7.

Chinese Office Action dated Mar. 28, 2023 in Chinese Application No. 202180006191.0.

Japanese Office Action dated May 9, 2023 in Japanese Application No. 2022-525467.

* cited by examiner

[Fig. 1]
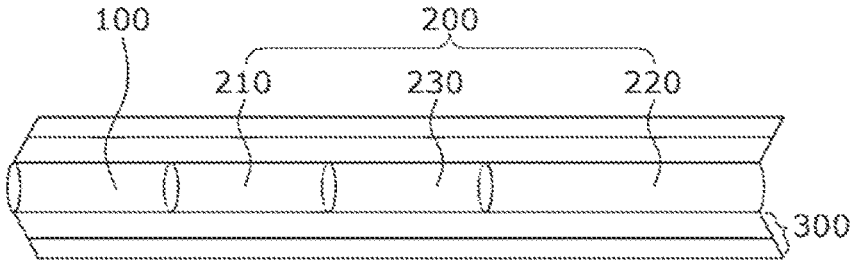
[Fig. 2]
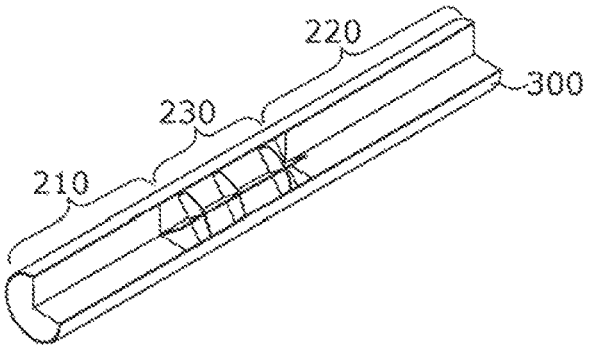
200: 210, 220 230
[Fig. 3]
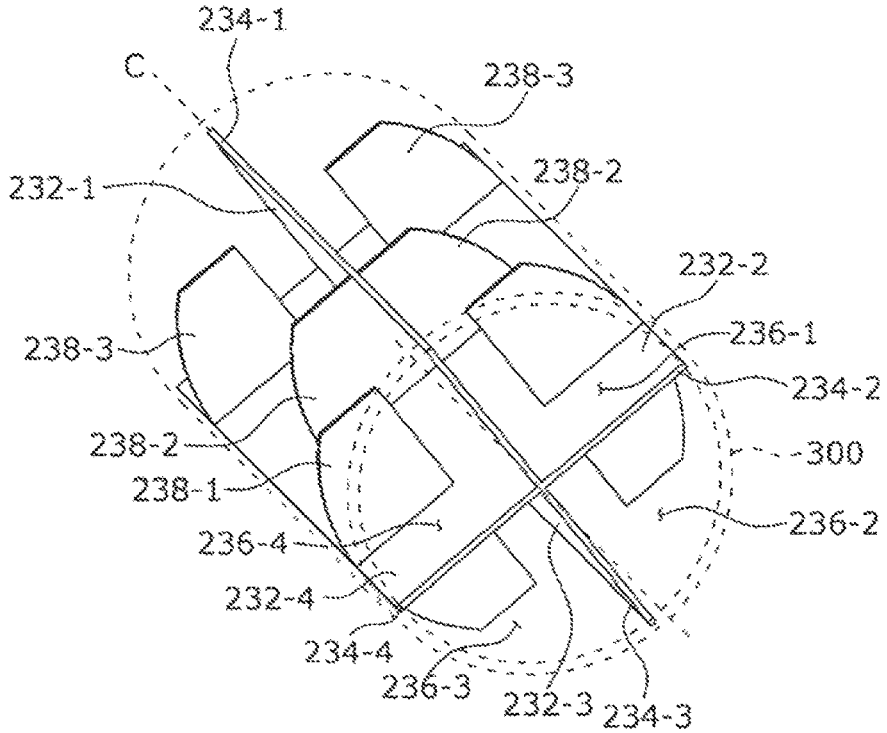
230: 232, 234, 236, 238
232: 232-1, 232-2, 232-3, 232-4
234: 234-1, 234-2, 234-3, 234-4
236: 236-1, 236-2, 236-3, 236-4
238: 238-1, 238-2, 238-3

[Fig. 4]
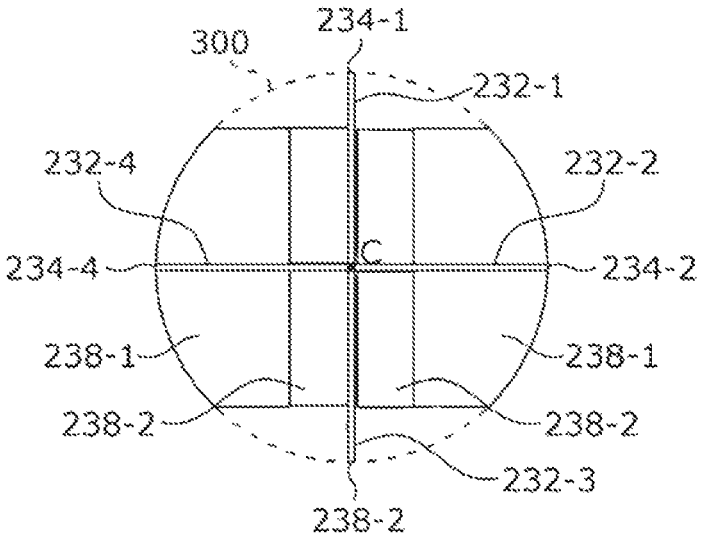
230: 232, 234, 236, 238
232: 232-1, 232-2, 232-3, 232-4
234: 234-1, 234-2, 234-3, 234-4
238: 238-1, 238-2
[Fig. 5]
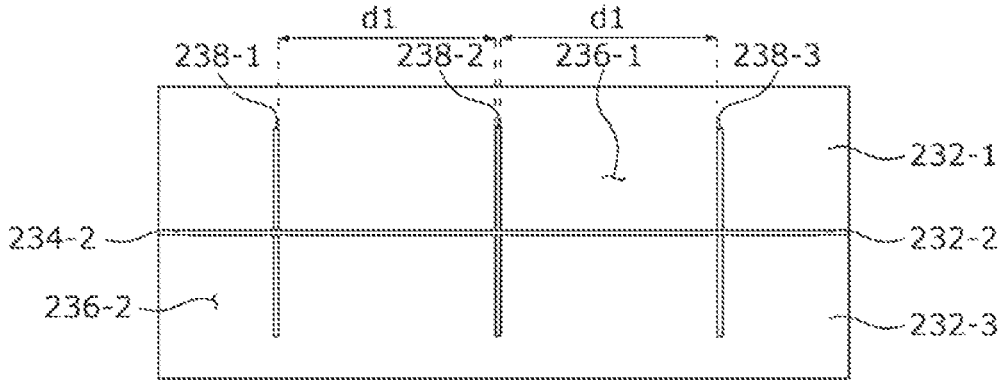
230: 232, 234, 236, 238
232: 232-1, 232-2, 232-3
234: 234-2
236: 236-1, 236-2
238: 238-1, 238-2, 238-3

[Fig. 6]
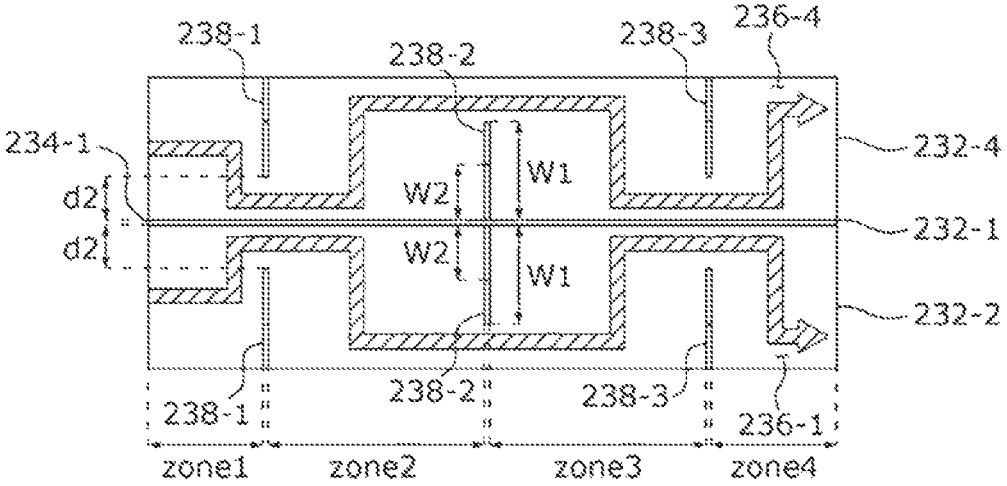
230: 232, 234, 236, 238
232: 232-1, 232-2, 232-4
234: 234-1
236: 236-1, 236-4
238: 238-1, 238-2, 238-3
[Fig. 7]
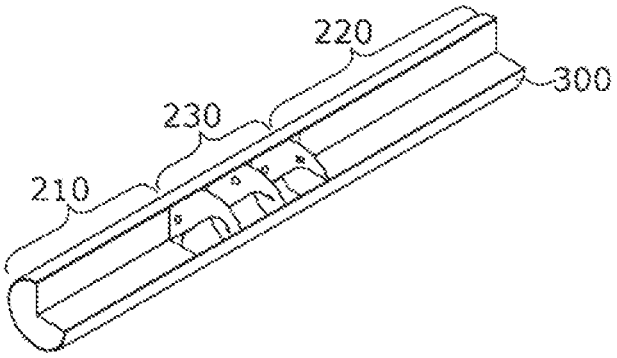
200: 210, 220 230
[Fig. 8]
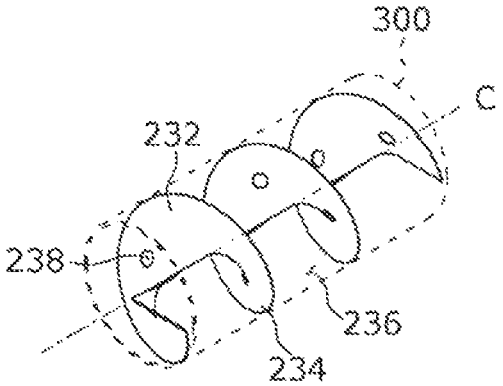
230: 232, 234, 236, 238

[Fig. 9]
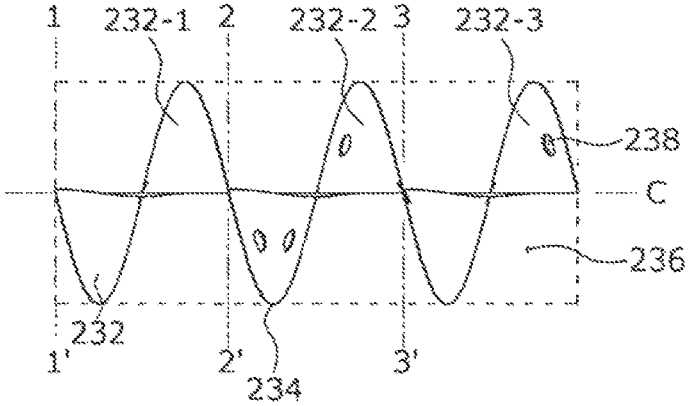
230: 232, 234, 236, 238
232: 232-1, 232-2, 232-3
[Fig. 10A]
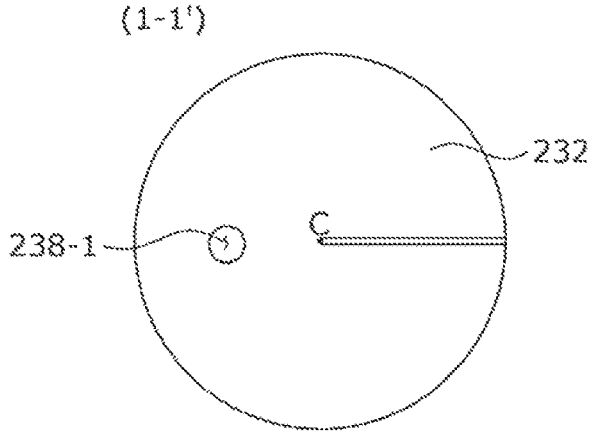
230: 232, 238
238: 238-1
[Fig. 10B]
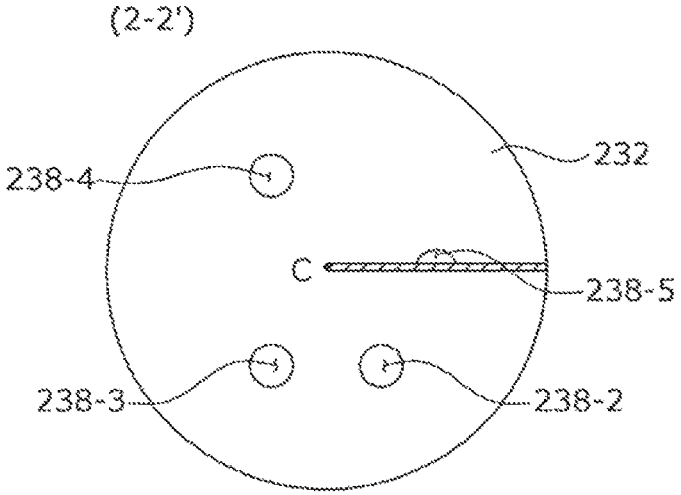
230: 232, 238
238: 238-2, 238-3, 238-4, 238-5

[Fig. 10C]
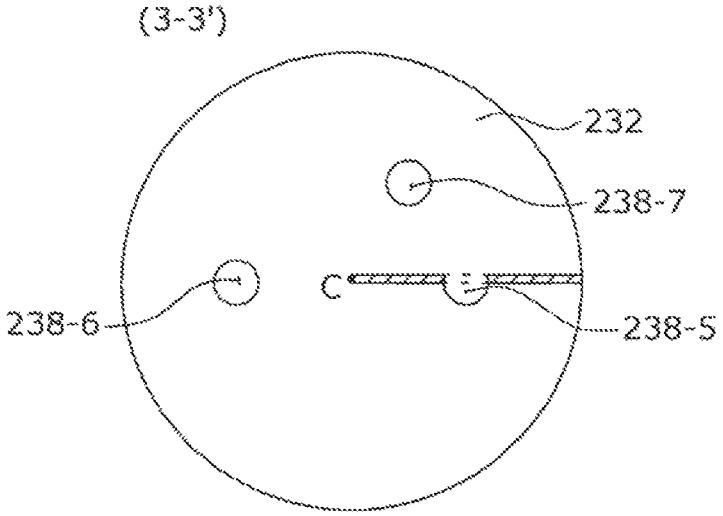
230: 232, 238
238: 238-5, 238-6, 238-7
[Fig. 11]
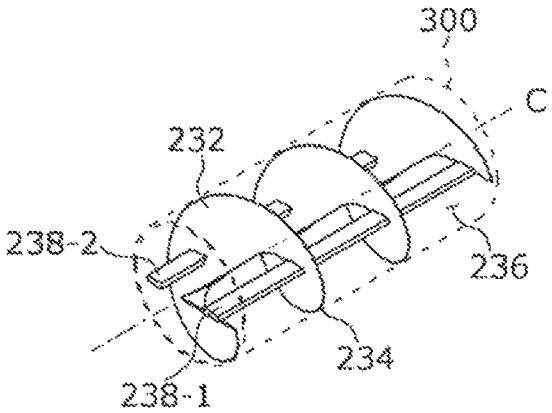
230: 232, 234, 236, 238
238: 238-1, 238-2
[Fig. 12]
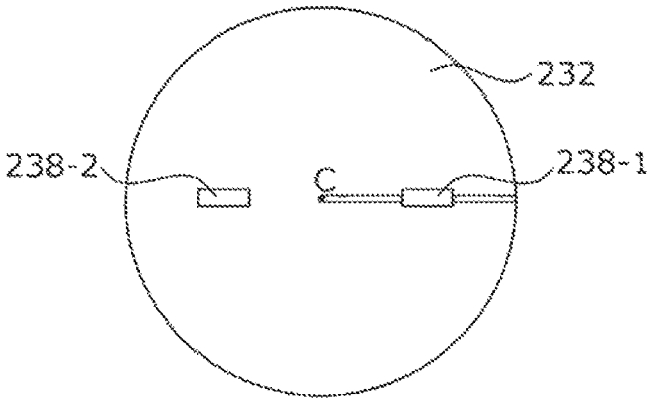
230: 232, 238
238: 238-1, 238-2

[Fig. 13]
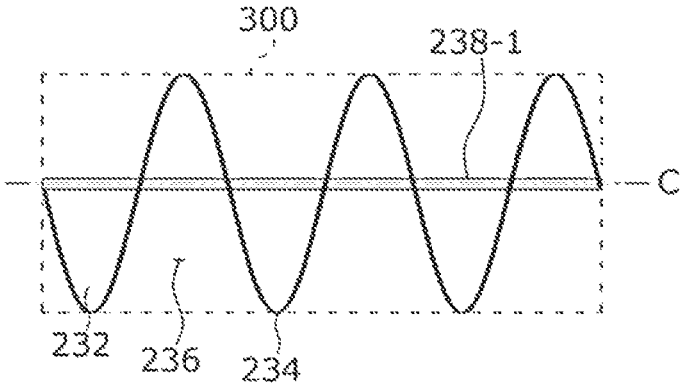
230: 232, 234, 236, 238
238: 238-1

AEROSOL-GENERATING ARTICLE

CROSS REFERENCE TO RELATED APPLICATIONS

This application is a National Stage of International Application No. PCT/KR2021/015674 filed Nov. 2, 2021, claiming priority based on Korean Patent Application No. 10-2020-0149289 filed Nov. 10, 2020.

TECHNICAL FIELD

Embodiments relate to an aerosol-generating article.

BACKGROUND ART

An aerosol generating article such as a combustion-type cigarette or a non-combustion type (e.g., heating-type) cigarette includes a filter rod for filtering a specific component included in aerosol or cooling the aerosol. Recently, research for improving filter performance by changing components constituting a filter rod or changing a structure of the filter rod has been conducted.

Because various components are generated when a combustion-type cigarette or a heating-type cigarette generates aerosol during smoking, an aerosol-generating article is required to homogenize such various components. Accordingly, there is a need for research for enabling a filter rod to perform homogenization of aerosol in addition to filtering and cooling

DISCLOSURE OF INVENTION

Technical Problem

A technical problem to be solved by the disclosure is to provide an aerosol-generating article capable of maintaining a shape of a filter rod even when an external force is applied.

Also, a technical problem to be solved by the disclosure is to provide an aerosol-generating article capable of improving homogeneity by mixing aerosol.

Technical problems to be solved by the disclosure are not limited thereto, and ob-jectives or effects which may be derived from the following solution or embodiments may also be included.

Solution to Problem

An aerosol-generating article according to an embodiment of the disclosure includes: a tobacco rod having an outer circumferential surface surrounded by a wrapper; and a filter rod having an outer circumferential surface surrounded by the wrapper, and including a structure supporting the wrapper in a transverse direction and at least one channel formed between the wrapper and the structure; and an airflow obstruction configured to obstruct an airflow of aerosol passing through the at least one channel.

The structure may include a plurality of support surfaces contacting an inner circumferential surface of the wrapper in a longitudinal direction.

The structure may further include a plurality of plates extending from longitudinal axis to the inner circumferential surface of the wrapper.

The airflow obstruction may include a plurality of colliding bodies perpendicularly coupled to at least one of the plurality of plates.

The plurality of colliding bodies may include: a first colliding body perpendicularly coupled to a second plate and spaced apart from a first plate by a certain distance; and a second colliding body perpendicularly coupled to the second plate and perpendicularly coupled to the first plate.

A width of the second colliding body may be greater than a separation distance between the first colliding body and the first plate.

The structure may include at least one support surface spirally contacting an inner circumferential surface of the wrapper in a longitudinal direction.

The structure may further include a spiral plate member spirally formed along a longitudinal axis.

The airflow obstruction may include a plurality of holes formed in the spiral plate member.

The spiral plate member may include: a first spiral portion having no overlapping portions in the longitudinal direction; and a second spiral portion having no overlapping portions in the longitudinal direction and extending from an end of the first spiral portion, wherein the plurality of holes do not overlap between the first spiral portion and the second spiral portion in the longitudinal direction.

The airflow obstruction may include at least one colliding body spaced apart from the longitudinal axis by a certain distance and passing through the spiral plate member in the longitudinal direction.

The wrapper may include at least one ventilation hole located in a portion surrounding the filter rod and allowing an external component to be introduced therethrough into the channel.

Advantageous Effects of Invention

According to an embodiment of the disclosure, when an aerosol-generating article is stored and used, deformation of a shape may be minimized, and thus design charac-teristics may be maintained. As a result, a smoking feeling as intended through the design may be provided to a user.

Also, according to an embodiment of the disclosure, because aerosol is mixed by a vortex or the like when the aerosol flows through a channel, the homogeneity of the aerosol may be improved.

Various and beneficial advantages and effects of the disclosure are not limited thereto, and will be more easily understood in the course of describing specific embodiments of the disclosure.

BRIEF DESCRIPTION OF DRAWINGS

FIG. 1 is a view for describing an aerosol-generating article according to an embodiment of the disclosure.

FIG. 2 is a perspective view illustrating a filter rod including segments according to a first embodiment of the disclosure.

FIG. 3 is a perspective view illustrating a third segment according to the first embodiment of the disclosure.

FIG. 4 is a front view illustrating the third segment according to the first embodiment of the disclosure.

FIG. 5 is a side view illustrating the third segment according to the first embodiment of the disclosure.

FIG. 6 is a top view illustrating the third segment according to the first embodiment of the disclosure.

FIG. 7 is a perspective view illustrating a filter rod including a third segment according to a second embodiment of the disclosure.

FIG. 8 is a perspective view illustrating the third segment according to the second embodiment of the disclosure.

FIG. 9 is a side view illustrating the third segment according to the second embodiment of the disclosure.

FIGS. 10A through 10C are longitudinal sectional views illustrating the third segment according to the second embodiment of the disclosure.

FIG. 11 is a perspective view illustrating a third segment according to a third embodiment of the disclosure.

FIG. 12 is a front view illustrating the third segment according to the third embodiment of the disclosure.

FIG. 13 is a side view illustrating the third segment according to the third embodiment of the disclosure.

MODE FOR THE INVENTION

As the disclosure allows for various changes and numerous examples, particular embodiments will be illustrated in the drawings and described in detail in the written description. However, this is not intended to limit the disclosure to particular modes of practice, and it will be understood that all changes, equivalents, and substitutes that do not depart from the spirit and technical scope of various embodiments are en-compassed in the disclosure.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the disclosure. As used herein, the term "and/or" includes any and all combinations of one or more of the associated listed items.

When a component is referred to as being "connected" or "accessed" to or by any other component, it should be understood that the component may be directly connected or accessed by the other component, but another new component may also be interposed between them. Contrarily, when a component is referred to as being "directly connected" or "directly accessed" to or by any other component, it should be understood that there is no new component between the component and the other component.

The terms used in the present specification are merely used to describe exemplary embodiments, and are not intended to limit the disclosure. As used herein, the singular forms "a," "an," and "the" are intended to include the plural forms as well, unless the context clearly indicates otherwise. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless defined otherwise, all terms used herein, including technical terms and scientific terms, have the same meaning as commonly understood by one of ordinary skill in the art to which the disclosure pertains. Such terms as those defined in a generally used dictionary are to be interpreted to have the meanings equal to the contextual meanings in the relevant field of art, and are not to be interpreted to have ideal or excessively formal meanings unless clearly defined in various embodiments of the disclosure.

Reference will now be made in detail to embodiments, examples of which are illustrated in the accompanying drawings. In the drawings, the same elements are denoted by the same reference numerals, and a repeated description thereof will not be given.

An aerosol-generating article according to an embodiment of the disclosure may refer to a cigarette. An aerosol-generating article according to an embodiment of the disclosure may be a cigarette that generates aerosol by burning a part. Also, an aerosol-generating article according to an embodiment of the disclosure may be a cigarette that generates aerosol when a part of the cigarette is heated by a heating source such as a heater assembly.

FIG. 1 is a view for describing an aerosol-generating article according to an embodiment of the disclosure.

Referring to FIG. 1, the aerosol-generating article may include a tobacco rod 100 and a filter rod 200.

The tobacco rod 100 may include an aerosol-generating material. For example, the aerosol-generating material may include at least one of, but not limited to, glycerin, propylene glycol, ethylene glycol, dipropylene glycol, diethylene glycol, triethylene glycol, tetraethylene glycol, and oleyl alcohol.

The tobacco rod 100 may include other additive materials such as a flavoring agent, a wetting agent, and/or an organic acid. For example, the flavoring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang, salvia, spearmint, ginger, coriander, or coffee. In addition, the wetting agent may include glycerine or propylene glycol.

A flavoring liquid such as menthol or a moisturizer may be sprayed and added to the tobacco rod 100.

The tobacco rod 100 may be filled with a reconstituent tobacco sheet. In another example, the tobacco rod 100 may be filled with tiny bits. The tiny bits may be generated by finely cutting the reconstituent tobacco sheet. In another example, the tobacco rod 100 may be filled with a plurality of tobacco strands obtained by finely cutting the reconstituent tobacco sheet. For example, the tobacco rod 100 may be formed by combining the plurality of tobacco strands arranged in the same direction (i.e., arranged parallel to each other) or randomly. For example, the reconstituent tobacco sheet may be manufactured by using the following process. First, a tobacco raw material is crushed to generate a slurry in which an aerosol-generating material (e.g., glycerin or propylene glycol), a flavoring liquid, a binder (e.g., guar gum, xanthan gum, or carboxymethyl cellulose (CMC)), and water are mixed, and then a reconstituent tobacco sheet is formed by using the slurry. Natural pulp or cellulose may be added to make a slurry, and one or more binders may be mixed and used. Tobacco strands may be generated by drying the reconstituent tobacco sheet and cutting or shredding the dried reconstituent tobacco sheet.

The tobacco raw material may be tobacco leaf fragments, tobacco stems, and/or tobacco powder generated during tobacco processing. In addition, the reconstituent tobacco sheet may contain other additives such as wood cellulose fiber. The slurry may contain 5% to 40% of aerosol-generating material, and 2% to 35% of aerosol-generating material may remain in the reconstituent tobacco sheet. Preferably, 5% to 30% of aerosol-generating material may remain in the reconstituent tobacco sheet. The tobacco rod 100 may be surrounded by a heat conductive material. For example, the heat conductive material may be, but is not limited to, a metal foil such as an aluminum foil. The heat conductive material surrounding the tobacco rod 100 may uniformly distribute heat transmitted to the tobacco rod 100, and thus heat conductivity applied to the tobacco rod 100 may be improved and the flavor of aerosol generated from the tobacco rod 100 may be improved. The filter rod 200 may contact the tobacco rod 100 and may be located downstream of the tobacco rod 100. The term "downstream" refers to a direction in which the aerosol flows toward the mouth of a user who smokes the aerosol-generating article. On the other hand, the term "upstream" may refer to a direction away from the mouth of the user who smokes the aerosol-generating article.

The filter rod 200 may include a plurality of segments. The plurality of segments may be sequentially arranged in a longitudinal direction. The term "longitudinal direction" may refer to a lengthwise direction of the aerosol-generating article.

According to an embodiment, one of the plurality of segments may be a first segment 210. The first segment 210 may be a cellulose acetate filter. For example, the first segment 210 may be a tubular structure having a hollow therein. The hollow may function as a channel through which aerosol passes. A length of the first segment 210 may be an appropriate length within a range of 4 mm to 30 mm, but the disclosure is not limited thereto. Preferably, a length of the first segment 210 may be, but is not limited to, 10 mm. A diameter of the hollow (channel) in the first segment 210 may be an appropriate diameter within a range of 3 mm to 4.5 mm, but the disclosure is not limited to.

The first segment 210 may contain a volatile flavor component. The volatile flavor component may be applied as a liquid to the first segment 210. The volatile flavor component may be, but is not limited to, menthol.

According to an embodiment, the first segment 210 may not be included in the filter rod 200. That is, the filter rod 200 may not include the first segment 210, and may include only a second segment 220 and a third segment 230.

One of the plurality of segments may be the second segment 220 capable of filtering a specific component of aerosol. The second segment 220 may be a cellulose acetate filter. A length of the second segment 220 may be appropriately selected within a range of 4 mm to 20 mm. For example, a length of the second segment 220 may be, but is not limited to, about 12 mm.

In a process of manufacturing the second segment 220, the second segment 220 may be manufactured to generate flavor by spraying a flavoring liquid to the second segment 220. Alternatively, a separate fiber to which a flavoring liquid is applied may be inserted into the second segment 220. Aerosol generated by the tobacco rod 100 is cooled as passing through the first segment 210, and the cooled aerosol is delivered to the user through the second segment 220. Accordingly, when a flavoring element is added to the second segment 220, the durability of flavor delivered to the user may be increased.

Any one of the plurality of segments may be the third segment 230. According to an embodiment, the third segment 230 may cool aerosol that is generated when the tobacco rod 100 is burned or when the tobacco rod 100 is heated by a heater. Accordingly, the user may inhale the aerosol cooled to a suitable temperature. According to an embodiment, the third segment 230 may support a wrapper 300 surrounding the segments included in the filter rod 200. Accordingly, a circular shape of the aerosol-generating article may be maintained when the user inhales aerosol. According to an embodiment, the third segment 230 may mix an aerosol airflow. Accordingly, the user may inhale homogenized aerosol. The third segment 230 may include a structure and a channel. The third segment 230 may include an airflow obstruction.

The structure may support the wrapper 300 in a transverse direction. A plurality of structures may be formed. The channel may be formed between the wrapper 300 and the structure. One or a plurality of channels may be formed.

According to an embodiment, the structure may include a plurality of support surfaces contacting an inner circumferential surface of the wrapper 300 in the longitudinal direction. The longitudinal direction may refer to a lengthwise direction of an aerosol-generating device.

The structure may include a plurality of plates extending toward the inner circumferential surface of the wrapper from a central axis that extends in the longitudinal direction (i.e., longitudinal axis). In this case, a plurality of channels may be formed between the plurality of plates. An angle formed between two adjacent plates of the plurality of plates may be 180/n. In this case, n may be a positive integer. For example, the plurality of plates may include a first plate, a second plate, a third plate, and a fourth plate. The second plate may be arranged perpendicular to the first plate. The third plate may be parallel to the first plate with the central axis located in between. The fourth plate may be parallel to the second plate with the central axis located in between. In this case, the channel may be formed between plates, and the third segment 230 may include four channels.

The airflow obstruction may include a plurality of colliding bodies that are arranged perpendicular to at least one of the plurality of plates. The plurality of colliding bodies may include a first colliding body and a second colliding body. The first colliding body may be perpendicularly coupled to the second plate, and may be spaced apart from the first plate by a certain distance. The second colliding body may be perpendicularly coupled to the second plate, and may be perpendicularly coupled to the first plate. A width of the second colliding body may be greater than a certain interval formed between the first colliding body and the first plate.

According to an embodiment, the structure may include at least one support surface spirally contacting the inner circumferential surface of the wrapper 300 along the longitudinal direction. In this case, the third segment 230 may include a channel for forming a vortex of aerosol around the longitudinal axis.

As will be described below with reference to FIGS. 7-13, the structure may include a spiral plate member that spirally formed along the central axis of the longitudinal direction (i.e., longitudinal axis). In this case, the structure may have a hollow formed along the longitudinal central axis. An airflow of aerosol may be formed along the hollow. In another example, a central portion of the structure along the longitudinal axis may be sealed.

The airflow obstruction may include at least one colliding body. According to an embodiment, the at least one colliding body may be spaced apart from the longitudinal axis by a certain distance and may pass through the spiral plate member in the ion-gitudinal direction. In another embodiment, the at least one colliding body of the airflow obstruction may have a plurality of holes formed in the spiral plate member. The spiral plate member may include a first spiral portion having no overlapping portions in the longitudinal direction and a second spiral portion having no overlapping portions in the longitudinal direction and extending from an end of the first spiral portion. In this case, a plurality of holes formed in the first spiral portion may not overlap holes formed in the second spiral portion in the longitudinal direction.

The wrapper 300 may be wrapped around the tobacco rod 100 and the filter rod 200. The wrapper 300 may surround outer circumferential surfaces of the tobacco rod 100 and the filter rod 200. According to an embodiment, the tobacco rod 100 and the filter rod 200 may be packaged by one wrapper 300. In another embodiment, the tobacco rod and the filter rod 200 may be packaged by two or more wrappers 300. In detail, the tobacco rod 100 may be packaged by a first wrapper, and the filter rod 200 may be packaged by a second wrapper. The tobacco rod 100 packaged by the first wrapper and the filter rod 200 packaged by the second wrapper may be re-packaged by a third wrapper. In another embodiment, the plurality of segments included in the filter rod may be packaged by different wrappers 300. In detail, the first segment 210 may be packaged by a 3-1$^{st}$ wrapper, the second segment 220 may be packaged by a 3-2$^{nd}$ wrapper, and the third segment 230 may be packaged by a 3-3$^{rd}$ wrapper. The plurality of segments respectively packaged by the wrappers 300 and the tobacco rod 100 packaged by the first wrapper may be re-packaged by one wrapper 300.

The wrapper 300 may have at least one ventilation hole in a portion surrounding any one segment included in the filter rod 200. For example, at least one ventilation hole of the wrapper may be located in a portion corresponding to the third segment 230. The wrapper 300 may refer to wrapping paper. An external component (e.g., air) of the aerosol-generating article may be introduced into the channel through the ventilation hole. A component in the channel may be discharged to the outside of the channel through the ventilation hole.

FIG. 2 is a perspective view illustrating a filter rod including a segment according to a first embodiment of the disclosure.

Referring to FIG. 2, a filter rod according to an embodiment of the disclosure may include the first through third segments 210 through 230.

According to an embodiment, as shown in FIG. 2, the segments of the filter rod 200 may be arranged in the order of the first segment 210, the third segment 230, and the second segment 220 along a downstream direction (i.e., a direction in which the aerosol generated in the tobacco rod 100 flows toward the user's mouth). According to another embodiment, the segments may be arranged in the order of the first segment 210, the second segment 220, and the third segment 230 along the downstream direction. According to another embodiment, the segments may be arranged in the order of the third segment 230, the first segment 210, and the second segment 220 along the downstream direction. That is, when the filter rod is divided into an upper end, a middle end, and terminal end, the third segment 230 may be located in any one of the upper end, the middle end, and the terminal end.

The filter rod including the first through third segments 210 through 230 may be packaged by the wrapper 300. That is, the wrapper 300 may surround an outer circumferential surface of the filter rod including the first through third segments 210 through 230. As the wrapper 300 surrounds an outer circumferential surface of the third segment 230, a plurality of channels may be formed between the filter rod and a structure included in the third segment 230.

FIG. 3 is a perspective view illustrating the third segment according to the first embodiment of the disclosure. FIG. 4 is a front view illustrating the third segment according to the first embodiment of the disclosure. FIG. 5 is a side view illustrating the third segment according to the first embodiment of the disclosure. FIG. 6 is a top view illustrating the third segment according to the first embodiment of the disclosure.

The third segment 230 according to the first embodiment of the disclosure may include a structure. The wrapper may surround the third segment 230, that is, the structure. As the wrapper 300 surrounds the structure, the third segment 230 may include a plurality of channels formed by the structure and the wrapper 300.

A structure 232 may include a plurality of support surfaces 234 contacting an inner circumferential surface of the wrapper 300 in a longitudinal direction. Referring to FIGS. 3 through 6, the structure 232 may include four support surfaces 234 contacting the wrapper 300. The four support surfaces 234 may be formed in a lengthwise direction of an aerosol-generating device which is the longitudinal direction. The four support surfaces 234 may be symmetric about a central axis C (i.e., longitudinal axis). A first support surface 234-1 and a third support surface 234-3 may be symmetric to each other about the central axis C. A second support surface 234-2 and a fourth support surface 234-4 may be symmetric to each other about the central axis C. Even if a force is applied to the wrapper 300 surrounding an outer circumferential surface of the third segment 230 in a transverse direction, a shape of the filter rod may be maintained because the force may be offset through symmetric support surfaces 234. Although the number of the support surfaces 234 is not limited, it is preferable that the structure 232 includes three or more support surfaces 234 to increase a support force. According to an embodiment, it is preferable that the structure 232 includes an even number of support surfaces 234 and paired support surfaces 234 are symmetric to each other about the central axis C.

The structure 232 may include a plurality of plates 232-1 through 232-4 extending from the central axis C to the inner circumferential surface of the wrapper 300. The plurality of plates 232-1 through 232-4 may respectively correspond to the plurality of support surfaces 234-1 through 234-4. That is, each of the plurality of plates 232-1 through 232-4 may include one support surface 234. As the plurality of plates 232-1 through 232-4 extend from the central axis C to the inner circumferential surface of the wrapper 300, forces applied to the wrapper in a transverse direction may be transferred to the central axis C through the support surfaces 234. As the forces transferred to the central axis C are offset, a shape of the filter rod may be maintained.

A certain angle may be formed by every two adjacent plates of the plurality of plates 232-1 through 232-4. In this case, certain angles formed by two plates may be the same. As the certain angles formed by the two plates are the same, forces applied to the wrapper in the transverse direction may be efficiently offset. According to an embodiment, an angle formed by two adjacent plates of the plurality of plates 232-1 through 232-4 may be 360/m. In this case, m may be a positive integer equal to or greater than 2. According to an embodiment, an angle formed by two adjacent plates of the plurality of plates 232-1 through 232-4 may be 180/n. In this case, n may be a positive integer. According to an embodiment, the plurality of plates may be integrally formed. In another embodiment, the plurality of plates 232-1 through 232-4 may be separately formed and then may be coupled to one another. In another example, a pair of plates that are arranged parallel to each other may be integrally formed and then in-dividual plates may be coupled to one another.

The plurality of plates may support other segments connected to a front end a rear end of the third segment 230 or a tobacco rod in the longitudinal direction. Because the plurality of plates provide another support surface for the front end and the rear end of the third segment 230, a shape may be maintained against a force applied to the aerosol-generating device in the longitudinal direction.

Referring to FIGS. 3 through 6, the plurality of plates may include four plates. The plurality of plates may include the first plate 232-1, the second plate 232-2, the third plate 232-3, and the fourth plate 232-4. The first plate 232-1 may extend from the central axis C to the inner circumferential surface of the wrapper 300, and may support the wrapper 300 through the first support surface 234-1. The second plate 232-2 may extend from the central axis C to the inner circumferential surface of the wrapper 300, and may be arranged perpendicular to the first plate 232-1. The second plate 232-2 may support the wrapper 300 through the second support surface 234-2. The third plate 232-3 may extend from the central axis C to the inner circumferential surface of the wrapper 300, and may be parallel to the first plate 232-1 with the central axis C located in between. The third plate 232-3 may support the wrapper 300 through the third support surface 234-3 that is symmetric to the first support surface 234-1 about the central axis C. The fourth plate 232-4 may extend from the central axis C to the inner circumferential surface of the wrapper 300, and may be parallel to the second plate 232-2 with the central axis C located in between. The fourth plate 232-4 may support the wrapper 300 through the fourth support 234-4 that is symmetric to the second support 234-2 about the central axis C. The first plate 232-1 may be at right angles to the second plate 232-2 and the fourth plate 232-4 which are adjacent to the first plate 232-1. The third plate 232-3 may be at right angles to the second plate 232-2 and the fourth plate 232-4 which are adjacent to the third plate 232-3.

An airflow obstruction 238 may be located in the structure 232. The airflow obstruction 238 may include a plurality of colliding bodies that may be perpendicularly coupled to at least one of the plurality of plates. The plurality of colliding bodies may include first colliding bodies 238-1 and 238-3 and a second colliding body 238-2.

Referring to FIGS. 3 through 6, the first colliding body 238-1 may be arranged upstream of the first colliding body 238-3, and the second colliding body 238-2 may be located between the first colliding bodies 238-1 and 238-3 such that the first colliding body 238-1, the second colliding body 238-2, and the first colliding body 238-3 are sequentially arranged in the longitudinal direction.

The arrangements of the first colliding bodies 238-1 and 238-3 and the second colliding body 238-2 may be changed according to embodiments. For example, the first colliding bodies 238-1 and 238-3 may be sequentially arranged in the longitudinal direction without the second colliding body 238-2 present in between. In this case, the second colliding body 238-2 may be arranged upstream of the first colliding bodies 238-1 or downstream of the first colliding body 238-3.

The first colliding bodies 238-1 and 238-3 and the second colliding body 238-2 may be spaced apart from each other. Referring to FIGS. 3 through 6, each of the first colliding bodies 238-1 and 238-3 may be spaced apart from the second colliding body 238-2 by a first distance d1. However, this is merely an example, and a distance between the second colliding body 238-2 and the first colliding bodies 238-1 and 238-3 may be changed by one of ordinary skill in the art. For example, a distance between the first colliding body 238-1 and the second colliding body 238-2 may be different from a distance between the second colliding body 238-2 and the first colliding body 238-3.

Referring to FIGS. 3 through 6, the first colliding bodies 238-1 and 238-3 may be to the second plate 232-2. The first colliding bodies 238-1 and 238-3 may be perpendicularly coupled to the second plate 232-2. Also, the first colliding bodies 238-1 and 238-3 may be coupled to the fourth plate 232-4. The first colliding bodies 238-1 and 238-3 may be perpendicularly coupled to the fourth plate 232-4. The term "perpendicular" does not necessary mean that an angle of 90° is formed with respect to the second plate 232-2 and the fourth plate 232-4, but may mean a direction toward the inner circumferential direction of the wrapper 300.

The first colliding body 238-1 may be spaced apart from the first plate 232-1 by a certain distance. Referring to FIGS. 3 through 6, the first colliding bodies 238-1 and 238-3 may be spaced apart from the first plate 232-1 by a second distance d2. Also, the first colliding bodies 238-1 and 238-3 may be spaced apart from the third plate 232-3 by the second distance d2. However, this is merely an example, and a distance between the first plate 232-1 (or the third plate 232-3) and the first colliding bodies 238-1 and 238-3 may be changed by one of ordinary skill in the art. For example, a distance between the first colliding body 238-1 and the first plate 232-1 may be different from a distance between the first colliding body 238-3 and the first plate 232-1.

Referring to FIGS. 3 through 6, the second colliding body 238-2 may be coupled to the second plate 232-2. The second colliding body 238-2 may be perpendicularly coupled to the second plate 232-2. The second colliding body 238-2 may be coupled to the fourth plate 232-4. The second colliding body 238-2 may be perpendicularly coupled to the fourth plate 232-4. The term "perpendicular" does not necessarily mean that an angle of 90° is formed with respect to the second plate 232-2 and the fourth plate 232-4, but may mean a direction toward the inner circumferential of the wrapper 300.

Referring to FIGS. 3 through 6, the second colliding body 238-2 may be coupled to the first plate 232-1. The second colliding body 238-2 may be perpendicularly coupled to the first plate 232-1. The second colliding body 238-2 may be coupled to the third plate 232-3. The second colliding body 238-2 may be perpendicularly coupled to the third plate 232-3. The term "perpendicular" does not necessarily mean that an angle of 90° is formed with respect to the first plate 232-1 and the third plate 232-3, but may mean a direction toward the inner circumferential surface of the wrapper 300. Because the second colliding body 238-2 is coupled to the first plate 232-1 (and the third plate 232-3), a flow path may not be formed between the second colliding body 238-2 and the first plate 232-1 (and the third plate 232-3), unlike between the first colliding bodies 238-1 and 238-3 and the first plate 232-1 (and the third plate 232-3).

A width of the second colliding body 238-2 may be greater than a distance between the first colliding body 238-1 and the first plate 232-1. Referring to FIGS. 3 through 6, the second colliding body 238-2 may have a first width w1 and a second width w2. The first width w1 may be the largest width, and the second width w2 may be the smallest width. The second width w2 may be greater than a distance (e.g., d2) between the first colliding body 238-1 and the first plate 232-1. The second width w2 may be greater than a distance (e.g., d2) between the first colliding body 238-3 and the first plate 232-1.

The first colliding bodies 238-1 and 238-3 and/or the second colliding body 238-2 may include a support surface supporting the wrapper 300. Referring to FIGS. 3 through 6, the first colliding body 238-1 may include a support surface supporting the wrapper 300. Although the second colliding body 238-2 does not include a support surface supporting the wrapper 300, in another embodiment, the second colliding body 238-2 may also include a support surface supporting the wrapper 300.

A plurality of channels 236 may be formed by the structure 232 and the wrapper 300 surrounding the structure 232. One channel 236 may be formed by two adjacent plates and the wrapper 300 surrounding a space between the two plates. Accordingly, the number of the plurality of plates and the number of the plurality of channels 236 may be the same. When a user smokes, an aerosol airflow may be formed in each of the plurality of channels 236. Because each of the plurality of channels 236 includes a surface of each of two plates and a wrapper surface surrounding the plates, the channel may accelerate cooling of aerosol.

Referring to FIGS. 3 through 6, the third segment 230 may include first through fourth channels 236-1 through 236-4. The first channel 236-1 may be formed by the first plate 232-1, the second plate 232-2, and the wrapper. The second channel 236-2 may be formed by the second plate 232-2, the third plate 232-3, and the wrapper 300. The third channel 236-3 may be formed by the third plate 232-3, the fourth plate 232-4, and the wrapper 300. The fourth channel 236-4 may be formed by the fourth plate 232-4, the first plate 232-1, and the wrapper 300.

When the user smokes, an aerosol airflow may be formed in each of the first through fourth channels 236-1 through 236-4. The aerosol airflow passing through each channel may collide with the first colliding bodies 238-1 and 238-3 and the second colliding body 238-2. In detail, at least a part of an aerosol airflow introduced from an upstream side of the third segment 230 may collide with the first colliding body 238-1 in a first region zone1 and then may pass through a flow path between the first colliding body 238-1 and the second plate 232-2. The aerosol airflow passing through the flow path between the first colliding body 238-1 and the second plate 232-2 may collide with the second colliding body 238-2 in a second region zone2, and then may pass through a flow path formed by the second colliding body 238-2 and the wrapper 300. The aerosol airflow passing through the flow path formed by the second colliding body 238-2 and the wrapper 300 may collide with the first colliding body 238-3 in a third region zone3, and then may pass through a flow path between the first colliding body 238-3 and the second plate 232-2 to reach a fourth region zone4. Accordingly, a zigzag-shaped aerosol airflow may be formed in the channel 236. As an aerosol passes through the third segment 230 and collides with each colliding body, the aerosol may be mixed and homogenized, thereby improving a smoking feeling.

FIG. 7 is a perspective view illustrating a filter rod including a third segment according to a second embodiment of the disclosure.

Referring to FIG. 7, the filter rod 200 according to an embodiment of the disclosure may include the first through third segments 210 through 230.

According to an embodiment, as shown in FIG. 7, the segments of the filter rod 200 may be sequentially arranged in the order of the first segment 210, the third segment 230, and the second segment 220 along a downstream direction. According to another embodiment, the segments of the filter rod 200 may be sequentially arranged in the order of the first segment 210, the second segment 220, and the third segment 230 along the downstream direction. According to another embodiment, the segments of the filter rod 200 may be sequentially arranged in the order of the third segment 230, the first segment 210, and the second segment 220 along the downstream direction. That is, when the filter rod 200 is divided into an upper end, a middle end, and a terminal end, the third segment 230 may be located in any one of the upper end, the middle end, and the terminal end.

The filter rod 200 including the first through third segments 210 through 230 may be packaged by the wrapper 300. That is, the wrapper 300 may surround an outer circumferential surface of the filter rod 200 including the first through third segments 210 through 230. As the wrapper 300 surrounds an outer circumferential surface of the third segment 230, a channel may be formed between a structure included in the third segment 230 and the filter rod 200. In this case, the structure may have a spiral shape.

FIG. 8 is a perspective view illustrating the third segment according to the second embodiment of the disclosure. FIG. 9 is a side view illustrating the third segment according to the second embodiment of the disclosure. FIGS. 10A through 10C are longitudinal sectional views illustrating the third segment according to the second embodiment of the disclosure.

The third segment 230 according to the second embodiment of the disclosure may include the structure 232. The wrapper 300 may surround the third segment 230, that is, the structure 232. As the wrapper 300 surrounds the structure 232, the third segment may include the channel 236 formed by the structure 232 and the wrapper 300.

The structure 232 may include at least one support surface 234 spirally contacting an inner circumferential surface of the wrapper 300 in a longitudinal direction. Referring to FIGS. 8 through 10C, the structure 232 may include one support surface 234 contacting the wrapper 300. The one support surface 234 may be spirally formed in a lengthwise direction of an aerosol-generating device which is the longitudinal direction. The support surface 234 that is spirally formed may maintain a certain interval in the longitudinal direction. The support surface 234 that is spirally formed may have a certain angle with respect to a cross-section taken perpendicular to the longitudinal direction. An interval in the longitudinal direction and an angle with respect to the cross-section for the support surface 234 may be changed by one of ordinary skill in the art.

Because a force applied to the wrapper 300 surrounding the outer circumferential surface of the third segment 230 in a transverse direction may be offset by the support surface 234 that is spirally formed, a shape of the filter rod 200 may be maintained. Also, the structure 232 may support other segments connected to a front end and a rear end of the third segment 230 or a tobacco rod in the longitudinal direction. Because the structure 232 may provide another support surface for the front end and the rear end of the third segment 230, a shape may be maintained against a force applied to the aerosol-generating device in the longitudinal direction.

The structure 232 may include a spiral plate member that is spirally formed along the central axis C that extends in the longitudinal direction (i.e., longitudinal axis). The spiral plate member may have a helicoidal shape obtained by twisting one plate. According to an embodiment, the spiral plate member may include a first edge and a second edge, which spirally extend in the lengthwise direction. The first edge surrounds the central axis C and the second edge is spaced apart from the central axis C by a certain distance. Accordingly, a central portion of the structure 232 along the central axis C may be sealed. According to another embodiment, the spiral plate member may have a helicoidal shape in which the first edge is spaced apart from the central axis C by a first distance and the second edge is spaced apart from the central axis C by a second distance. The first distance may be smaller than the second distance. Accordingly, the structure 232 may have a hollow formed along the central axis C in the longitudinal direction.

Referring to FIGS. 8 through 10C, the structure 232 includes the spiral plate member. The spiral plate member may include the first edge and the second edge which spirally extend in the longitudinal direction. The first edge surrounds the central axis C and the second edge is spaced apart from the central axis C by a certain distance. The support surface 234 having a spiral shape may be located on the second edge. As the first edge of the spiral plate member surrounds the central axis C and the second edge is spaced apart from the central axis C by a certain distance, the central portion of the structure 232 may be sealed. Accordingly, a force applied to the wrapper 300 surrounding the outer circumferential surface of the third segment 230 in the transverse direction may be transferred to the central axis C through the support surface 234 formed on the second edge, and thus the force may be efficiently offset.

The airflow obstruction 238 may be located in the structure 232. The airflow obstruction 238 may have a plurality of holes formed in the spiral plate member. According to an embodiment of the disclosure, the spiral plate member may be divided into a plurality of spiral portions. The plurality of spiral portions may sequentially extend. For example, when the spiral plate member includes first through third spiral portions 232-1 through 232-3, the second spiral portion 232-2 may extend from an end portion of the first spiral portion 232-1, and the third spiral portion 232-3 may extend from an end portion of the second spiral portion 232-2. Each spiral portion may have no overlapping portions in the longitudinal direction. That is, the first spiral portion 232-2 may have no overlapping portions in the longitudinal direction, the second spiral portion 232-2 may have no overlapping portions in the longitudinal direction, and the third spiral portion 232-3 may have no overlapping portions in the longitudinal direction. At least one hole may be formed in the plurality of spiral portions.

According to an embodiment of the disclosure, at least one hole formed in the first spiral portion 232-1 and at least one hole formed in the second spiral portion 232-2 extending from the first spiral portion 232-1 may not overlap each other in the longitudinal direction.

FIG. 10A is a sectional view of the first spiral portion 232-1 taken along line 1-1' of FIG. 9. Referring to FIG. 10A, a first hole 238-1 may be formed in the first spiral portion 232-1.

FIG. 10B is a sectional view of the second spiral portion 232-2 taken along line 2-2' of FIG. 9. Referring to FIG. 10B, a second hole 238-2 through a fourth hole 238-4 and a part of a fifth hole 238-5 may be formed in the second spiral portion 232-2. Referring to FIG. 10A and FIG. 10B, the first hole 238-1 formed in the first spiral portion 232-1 may not overlap the second hole 238-2 through the fourth hole and the part of the fifth hole 238-5 formed in the second spiral portion 232-2 in the longitudinal direction.

FIG. 10C is a sectional view of the third spiral portion 232-3 taken along line 3-3' of FIG. 9. Referring to FIG. 10C, a part of the fifth hole 238-5, a sixth hole 238-6, and a seventh hole 238-7 may be formed in the third spiral portion 232-3. Referring to FIG. 10B and FIG. 10C, the second hole 238-2 through the fourth hole and the part of the fifth hole 238-5 formed in the second spiral portion 232-2 may not overlap the part of the fifth hole 238-5, the sixth hole 238-6, and the seventh hole 238-7 formed in the third spiral portion 232-3 in the longitudinal direction.

Holes formed in spiral portions that are not consecutive may overlap each other in the longitudinal direction. Referring to FIGS. 10A and 10C, the first hole 238-1 formed in the first spiral portion 232-1 may overlap the third hole 238-6 formed in the third spiral portion 232-3 in the longitudinal direction.

The channel 236 may be formed by the structure 232 and the wrapper 300 surrounding the structure 232. Referring to FIGS. 8 through 10C, the channel 236 may be formed by the spiral plate member and the wrapper 300 surrounding the spiral plate member. In this case, one channel 236 may be formed. When a user smokes, an aerosol airflow may be formed in the channel 236. The channel 236 may form a vortex of aerosol around the central axis C. Because the channel 236 is formed by the spiral plate member and a surface of the wrapper 300 surrounding the spiral plate member, a contact area of aerosol passing through the channel 236 may be increased and cooling may be accelerated. In addition, homogenization of the aerosol may be improved due to the vortex. Also, an airflow may be formed in another direction due to a hole formed in the structure 232 and collide with a vortex formed in the channel. As a result, homogenization of aerosol may be improved. Also, because an aerosol airflow formed by a hole collides with the structure 232, homogenization of aerosol may be improved. For example, because a hole formed in the first spiral portion 232-1 of the structure and a hole formed in the second spiral portion 232-2 of the structure 232 do not overlap each other, an aerosol airflow formed through the hole formed in the first spiral portion 232-1 collides with the second spiral portion 232-2, thereby improving aerosol homogenization.

FIG. 11 is a perspective view illustrating a third segment according to a third embodiment of the disclosure. FIG. 12 is a front view illustrating the third segment according to the third embodiment of the disclosure. FIG. 13 is a side view illustrating the third segment according to the third embodiment of the disclosure.

The third segment 230 according to the third embodiment of the disclosure may include the structure 232. The wrapper 300 may surround the third segment 230, that is, the structure 232. As the wrapper 300 surrounds the structure 232, the third segment may include the channel 236 formed by the structure 232 and the wrapper 300.

The structure 232 may include at least one support surface 234 spirally contacting an inner circumferential surface of the wrapper 300 in a longitudinal direction. Referring to FIGS. 11 through 13, the structure 232 may include one support surface 234 contacting the wrapper 300. The one support surface 234 may be spirally formed in a lengthwise direction of an aerosol-generating device which is the longitudinal direction. The support surface 234 that is spirally formed may maintain a certain interval in the longitudinal direction. The support surface 234 that is spirally formed may have a certain angle with respect to a cross-section taken perpendicular to the longitudinal direction. An interval in the longitudinal direction and an angle with respect to the cross-section for the support surface 234 may be changed by one of ordinary skill in the art.

Because a force applied to the wrapper 300 surrounding an outer circumferential surface of the third segment 230 in a transverse direction may be offset by the support surface 234 that is spirally formed, a shape of a filter rod 200 may be maintained. Also, the structure 232 may support other segments connected to a front end and a rear end of the third segment 230 or a tobacco rod in the longitudinal direction. Because the structure 232 may provide another support surface for the front end and the rear end of the third segment 230, a shape may be maintained against a force applied to the aerosol-generating device in the longitudinal direction.

The structure 232 may include a spiral plate member that is spirally formed along the central axis C that extends in the longitudinal direction. The spiral plate member have a helicoidal shape obtained by twisting one plate. According to an embodiment, the spiral plate member may include a first edge and a second edge, which spirally extend in the lengthwise direction. The spiral plate member may have a helicoidal shape in which the first edge surrounds the central axis C and the second edge is spaced apart from the central axis C by a certain distance. Accordingly, a central portion of the structure 232 along the central axis C of the longitudinal direction may be sealed. According to another embodiment, the spiral plate member may have a helicoidal shape in which the first edge is spaced apart from the central axis C by a first distance and the second edge is spaced apart from the central axis C by a second distance. The first distance may be smaller than the second distance. Accordingly, the structure 232 may have a hollow formed along the central axis C.

Referring to FIGS. 11 through 13, the structure 232 includes the spiral plate member. The spiral plate member may include the first edge and the second edge in the lengthwise direction. The first edge may be spaced apart from the central axis C by the first distance, and the second edge may be spaced apart front the central axis C by the second distance. The support surface 234 that spirally contacts the wrapper 300 may be located on the second edge. As the first edge of the spiral plate member is spaced apart from the central axis C by the first distance and the second edge is spaced apart from the central axis C by the second distance, the hollow may be formed in the central portion of the structure 232. As the hollow is formed in the structure 232, manufacturing costs of the structure 232 may be reduced.

The channel 236 may be formed by the structure 232 and the wrapper 300 surrounding the structure 232. Referring to FIGS. 11 through 13, the channel 236 may be formed by the spiral plate member and the wrapper 300 surrounding the spiral plate member. When a user smokes, an aerosol airflow may be formed in the channel 236. The channel 236 may form a vortex of aerosol around the central axis C. Because the channel 236 is formed by the spiral plate member and the wrapper 300 surrounding the spiral plate member, a contact area of aerosol passing through the channel 236 may be increased and cooling may be accelerated. In addition, homogenization of aerosol may be improved due to the vortex. An aerosol airflow of a direction different from that of the vortex may be formed through the hollow formed in the central portion of the structure. The aerosol airflow formed along the hollow may collide with the vortex formed along a surface of the spiral plate member, thereby improving homogenization of aerosol.

The airflow obstruction 238 may be located in the structure 232. The airflow obstruction 238 may include at least one colliding body. Referring to FIGS. 11 through 13, the airflow obstruction 238 may include a first colliding body 238-1 and a second colliding body 238-2. The first colliding body 238-1 and the second colliding body 238-2 may have rod shapes.

At least one colliding body may pass through the spiral plate member in the longitudinal direction. When a plurality of colliding bodies are provided, the plurality of colliding bodies may be spaced apart from one another. Referring to FIGS. 11 through 13, each of the first colliding body 238-1 and the second colliding body 238-2 may pass through the spiral plate member in the longitudinal direction. The first colliding body 238-1 and the second colliding body 238-2 may be spaced apart from each other. As the first colliding body 238-1 and the second colliding body 238-2 pass through the spiral plate member in the longitudinal direction, an area where an aerosol airflow passing through the channel is obstructed may be increased. As the first colliding body 238-1 and the second colliding body 238-2 are spaced apart from each other by a certain interval, the number of collisions of the aerosol airflow passing through the channel may be increased. Accordingly, homogenization of aerosol may be improved.

While the embodiments of the disclosure have been illustrated and described above, the disclosure is not limited to the above-described specific embodiments. Numerous modifications and adaptations will be readily apparent to one of ordinary skill in this art from the detailed description and the embodiments without departing from the spirit and scope of the disclosure. For example, each element in an embodiment may be modified and implemented. It should be understood that differences related to modifications and adaptations are included in the scope of the disclosure defined by the appended claims.

The invention claimed is:

1. An aerosol-generating article comprising:

a tobacco rod extending along a longitudinal axis and having an outer circumferential surface surrounded by a wrapper;

a filter rod extending along the longitudinal axis and having an outer circumferential surface surrounded by the wrapper, the filter rod comprising (i) a structure configured to support the wrapper in a transverse direction and (ii) at least one channel formed between the wrapper and the structure; and an airflow obstruction configured to obstruct an airflow of aerosol passing through the at least one channel, wherein the structure comprises a first plate and a second plate that extend from the longitudinal axis to an inner circumferential surface of the wrapper and are arranged to be perpendicular to each other, wherein the airflow obstruction comprises two first colliding bodies arranged in the downstream direction and the upstream direction respectively, and a second colliding body arranged between the two first colliding bodies, wherein the two first colliding bodies are coupled to the second plate and spaced apart from the first plate, and wherein the second colliding body is coupled to the first plate and the second plate, wherein the two first colliding bodies comprise (i) a support surface that supports the inner circumferential surface of the wrapper and curves in a direction towards the first plate, and (ii) a straight edge that faces the first plate, wherein the two first colliding bodies and the second colliding body are spaced apart, the distance between the second colliding body and the downstream-arranged first colliding body is different from the distance between the second colliding body and the upstream-arranged first colliding body, and wherein the two first colliding bodies are spaced apart from the first plate, the distance between the first plate and the downstream-arranged first colliding body is different from the distance between the first plate and the upstream-arranged first colliding body, wherein the second colliding body comprises a surface that extends in a direction away from the first plate, wherein the surface of the second colliding body has a first width in the direction away from the first plate that is a largest width between the surface of the second colliding body and the first plate, wherein the surface of the second colliding body has a second width in the direction away from the first plate that is a smallest width between the surface of the second colliding body and the first plate, and wherein the second width is larger than the distance between the first plate and the downstream-arranged first colliding body and the distance between the first plate and the upstream-arranged first colliding body.

2. The aerosol-generating article of claim 1, wherein the structure comprises a plurality of support surfaces contacting the inner circumferential surface of the wrapper in a longitudinal direction.

3. An aerosol-generating article comprising:

a tobacco rod extending along a longitudinal axis and having an outer circumferential surface surrounded by a wrapper;

a filter rod extending along the longitudinal axis and having an outer circumferential surface surrounded by the wrapper, the filter rod comprising (i) a structure configured to support the wrapper in a transverse direction and (ii) at least one channel formed between the wrapper and the structure, the structure comprising a spiral plate member spirally formed along the longitudinal axis such that the spiral plate member is hollow along the longitudinal axis, the spiral plate member comprising (a) at least one support surface spirally contacting an inner circumferential surface of the wrapper in a longitudinal direction, (b) a first edge spaced apart from the longitudinal axis by a first distance, and (c) a second edge spaced apart from the longitudinal axis by a second distance that is larger than the first distance; and an airflow obstruction configured to obstruct an airflow of aerosol passing through the at least one channel, wherein the airflow obstruction comprises at least one rod-shaped colliding body spaced apart from the longitudinal axis by a certain distance and passing through the spiral plate member in the longitudinal direction, and a plurality of holes formed in the spiral plate member.

4. The aerosol-generating article of claim 3, wherein the spiral plate member comprises:

a first spiral portion having no overlapping portions in the longitudinal direction; and a second spiral portion having no overlapping portions in the longitudinal direction and extending from an end of the first spiral portion, and wherein the plurality of holes do not overlap between the first spiral portion and the second spiral portion in the longitudinal direction.

5. The aerosol-generating article of claim 1, wherein the wrapper comprises at least one ventilation hole located in a portion surrounding the filter rod and allowing an external component to be introduced therethrough into the at least one channel.

6. The aerosol-generating article of claim 3, wherein the wrapper comprises at least one ventilation hole located in a portion surrounding the filter rod and allowing an external component to be introduced therethrough into the at least one channel.

* * * * *